US007690430B1

(12) United States Patent
Hunziker

(10) Patent No.: US 7,690,430 B1
(45) Date of Patent: Apr. 6, 2010

(54) WELL CASING EXTRACTION ACCESSORIES AND METHOD

(76) Inventor: David G. Hunziker, P.O. Box 211, Fort Scott, KS (US) 66701

( * ) Notice: Subject to any disclaimer, the term of this patent is extended or adjusted under 35 U.S.C. 154(b) by 548 days.

(21) Appl. No.: 11/389,969

(22) Filed: Mar. 27, 2006

Related U.S. Application Data

(60) Provisional application No. 60/668,473, filed on Apr. 5, 2005, provisional application No. 60/559,597, filed on Apr. 5, 2004.

(51) Int. Cl.
*E21B 31/20* (2006.01)
*E21B 23/00* (2006.01)

(52) U.S. Cl. ..... 166/301; 166/98; 166/377; 294/86.22

(58) Field of Classification Search ..... 166/301, 166/377, 98, 99; 294/86.12, 86.22
See application file for complete search history.

(56) References Cited

U.S. PATENT DOCUMENTS

| | | | | | |
|---|---|---|---|---|---|
| 36,907 | A | | 11/1862 | Kerr | |
| 318,071 | A | | 5/1885 | Woodbridge | |
| 420,189 | A | | 1/1890 | Clark et al. | |
| 1,105,535 | A | | 7/1914 | Roberts | |
| 1,625,909 | A | | 4/1927 | Price | |
| 1,739,601 | A | * | 12/1929 | Marble | 294/86.12 |
| 1,754,736 | A | | 4/1930 | Bryant | |
| 1,763,703 | A | * | 6/1930 | Hinderliter | 166/301 |
| 1,830,207 | A | | 11/1931 | Mueller | |
| 1,863,045 | A | | 6/1932 | Randall et al. | |
| 1,863,046 | A | | 6/1932 | Githens et al. | |
| 2,184,681 | A | | 12/1939 | Osmun et al. | |
| 2,286,550 | A | | 6/1942 | Kelly et al. | |
| 2,769,655 | A | | 11/1956 | Holmes | |
| 2,863,348 | A | | 12/1958 | Conger | |
| 3,012,619 | A | | 12/1961 | Farque | |
| 3,036,855 | A | | 5/1962 | Siracusa | |
| 3,527,309 | A | | 9/1970 | Rassieur | |
| 3,561,545 | A | | 2/1971 | Rassieur | 173/166 |
| 3,654,690 | A | | 4/1972 | Hardin | 29/427 |
| 3,952,618 | A | * | 4/1976 | Seamon | 81/441 |
| 4,377,956 | A | | 3/1983 | Cooper | 81/444 |
| 4,638,871 | A | | 1/1987 | Rassieur | 173/26 |
| 4,997,225 | A | | 3/1991 | Denis | 294/86.25 |
| 5,150,752 | A | * | 9/1992 | Gunst et al. | 166/97.1 |

(Continued)

OTHER PUBLICATIONS

Product Information on CME-750X ATV mounted drilling rig. The Central Mine Equipment Company (St. Louis. Mo.) www.cmeco.com/750x.html (5 sheets) and www.cmeco.com/750xspec.html (2 sheets).

*Primary Examiner*—Kenneth Thompson
(74) *Attorney, Agent, or Firm*—Jonathan A. Bay

(57) ABSTRACT

A tool for extracting well pipe casings resembles an enlarged pipe-thread tap. The tool is designed to be suspended under and driven by the traveling rotary table and hydraulic vertical drive system of a conventional drilling rig. By this means, well pipe casings are withdrawn from wells by engaging the tops of such well pipe casings, and unlike the prior art, which grapples well pipe casings at their very bottom, and at the end of a cable. Unlike withdrawing casing by a cable pull, wherein cables stretch and unstuck casings might launch like projectiles, the extractor tool manages to withdraw well pipe casing in a recoilless manner, which is more controlled, and safer.

12 Claims, 4 Drawing Sheets

U.S. PATENT DOCUMENTS

| | | | | |
|---|---|---|---|---|
| 5,988,719 | A | 11/1999 | Lavender | 294/96 |
| 6,213,210 | B1 * | 4/2001 | Hailey | 166/277 |
| 6,213,693 | B1 | 4/2001 | Kato | 408/222 |
| 6,578,635 | B1 * | 6/2003 | Hailey | 166/277 |
| 6,615,919 | B2 | 9/2003 | Osgood et al. | 166/301 |
| 6,626,616 | B2 | 9/2003 | Costa | 408/124 |
| 6,681,858 | B2 * | 1/2004 | Streater | 166/301 |
| 7,036,595 | B2 * | 5/2006 | Hailey | 166/301 |

* cited by examiner

WELL CASING EXTRACTION ACCESSORIES AND METHOD

CROSS-REFERENCE TO PROVISIONAL APPLICATION(S)

This application claims the benefit of U.S. Provisional Application No. 60/668,473, filed Apr. 5, 2005, portions of which were originally presented as U.S. Provisional Application No. 60/559,597, filed Apr. 5, 2004. All the foregoing patent applications are fully incorporated herein by reference.

BACKGROUND OF THE INVENTION

1. Field of the Invention

The invention relates to wells and, more particularly, to grapples or extractors for withdrawing downhole objects. The object(s) of specific interest herein is the well casing typically comprising a downhole hollow tubeform, nowadays commonly an assembly of PVC pipe sections which twist together with counterpart internal and external threaded ends. The conventional occasion nowadays for wanting to withdraw such a casing out of the well is typically during the abandonment (decommissioning) of environmental monitoring wells.

2. Prior Art

FIGS. 1 and 2 show various aspects of the prior art which will be more particularly described next. Brief pause can be taken now to consider the background behind.

At some earlier time, groundwater monitoring/remediation wells are bored into the earth. An undersized casing is inserted into the bore hole about all the way to the bottom. Typically the casing comprises an assembly of PVC pipe sections which are twisted together with counterpart internal and external threaded ends to form a sealed casing as a whole. It is preferred to avoid use of adhesive to join together the joints in the PVC pipe assembly (or in the role of adding a further assurance that threaded joints remain joined) because the adhesive or any other chemical or compound that is likely to be utilized could leach or partially dissolve, thereby showing up as a contaminant and thereafter skewing/undermining the monitoring/remediation efforts.

Again, the casing—typically an assembly of PVC pipe sections twisted together by the counterpart internal and external threaded ends thereof—is undersized: —relative that is to the bore hole in which it is inserted. Thus such an undersized casing presents an annular gap between the bored earth and PVC pipe. This annular gap is backfilled. About the lowest ten feet (~3 m) or so is backfilled with sand, the remaining depth (dozens or hundreds of feet or meters) is backfilled with cement or the like, bentonite being a common substitute. Also, the lowest ten feet (~3 m) or so of the PVC pipe is produced as a screen (eg., perforated) to allow groundwater to seep in.

The foregoing describes what occurred a month to a decade earlier than the time with which the present invention is concerned. That is, to come forward to the present problem, there comes a time to abandon (decommission) the well. Regulatory authorities want the (PVC pipe) casing pulled all the way out, and the remaining bore sealed in with cement. If the (PVC pipe) casing is left in place downhole, there will always be a danger that polluted groundwater from a relatively higher substratum elevation might weep down the outer skin of the (PVC pipe) casing, because the cement (or the like) backfill fails to form a perfect seal, until the weeping-down polluted water contaminates groundwater in lower substratum levels.

To turn to another matter of the prior art, there is another piece of the background to note, which involves the field equipment used by the workers in this industry: —eg., their drilling rigs. Namely, such drilling rigs have two kinds of devices for retracting downhole tools: —ie., hydraulically-winched cables or lines in contrast to hydraulic cylinders.

It might be noted that hydraulically-winched cables and lines, when used to pull free a stuck object, typically include the danger of recoil. Conversely, hydraulic cylinders are essentially recoilless in the same situation. Also, the hydraulic-cylinder systems of such drilling rigs are powerful, and typically outmuscle the power of the hydraulic winches by several times.

A typical drilling rig utilized in the industry might comprise, for example and without limitation, a CME 750 All-terrain (rubber tire) vehicle drilling rig of the Central Mine Equipment Company in St. Louis, Mo. This is the carrier/drilling rig combination which is approximately illustrated in the drawings. More particular reference can be had to several patents of the CME Company for more particular disclosure of carrier/drilling rig features, including any of U.S. Pat. Nos. 3,527,309; 3,561,545 and/or 4,638,871—all of which are by C. L. Rassieur. The foregoing patent disclosures are incorporated fully herein by this reference thereto.

Such a carrier/drilling rig has a two-piece tower comprising, in the lower portion thereof, an undergirding upright, upon which is affixed a removable mast. The crown of the mast might be outfitted with as many as five sheaves. In a five sheave configuration, typically one sheave serves a wireline cable and winch, another serves softlines perhaps pulled by a cathead, and the remaining three would typically serve three cable-and-winch systems for winching up (eg.) sections of drill rod. The wireline cable and softline-cathead system are not pertinent to the present invention. Typically the wireline cable system reels up a wire relatively fast but with a weak hoist (eg., able to exert 900 pounds or ~400 kg of force or so) and is utilized in rock-coring, for example. The cathead is like a capstan on a ship, except oriented on a horizontal turning axis, and can winch in by means of one or two loops not only softlines but also cables and/or chains as well. It typically is a weak system too.

Stronger still are the (three or so) cable-and-winch systems. It is typical to equip the drilling rig with winches rated between about 1,800 or to 3,200 pounds (~700 to ~1,400 kg). It is also known to include at least one cable-and-winch system as a main one for fishing stuck objects and the like, and provide it with a retraction-force rating as high 10,000 pounds (~4,500 kg). Again, these three cable-and-winch systems are designed for, among other end uses, lifting up sections of drill rod. The height of the tower to the crown of the mast is typically something greater than twenty feet (~6 m) since that is a standard length of sections of drill rod. The above-ground height of the sheaves for the CME 750 ATV is about twenty-seven and a-half feet (~8⅓ m), which means that workers can hoist the twenty-foot rods with clearance to spare. When the CME 750 ATV is equipped with three such hoists (ie., cable-and-winch systems), workers can pull sixty feet of rods without having to lay any down on the ground or on the deck.

The upright (again, which undergirds the detachable mast) comprises legs and a standing rotary drive shaft (eg., a kelly bar, sometimes a square bar). The standing rotary drive bar typically has a lower end anchored in a main rotary drive and an upper end held in a bearing. The legs carry between (or among) themselves a traveling rotary table. Drive input to the rotary drive table is received from the standing rotary drive shaft as the traveling rotary table transits up and down the standing rotary drive shaft. The drill drive is typically a pair of serially-suspended links interconnected by a U-joint.

The hydraulic vertical drive system for cycling the traveling rotary drive table between feed (eg., pulldown) and retraction strokes typically comprises hydraulic cylinders which serve double-duty as the legs for the upright. The main rotary drive and the hydraulic vertical drive system are typically the strongest systems on the carrier/drilling rig. That is, the main rotary drive might deliver 10,000 ft-lbs (~13,5000 Nm) of rotary torque. The hydraulic vertical drive system can typically deliver a feed (pulldown) force in excess of the weight of the vehicle, or something on the order of 20,000 pounds (~9,000 kg).

The outstanding feature of the hydraulic vertical drive system is the retraction force it can develop: —30,000 pounds (~13,600 kg) for the CME 750 ATV, and then 40,000 pounds (~18,000 kg) being no problem for other models.

As an aside, another aside, another aspect of the hydraulic vertical drive system is that its drive stroke is only about five and a-half feet (~1⅔ m) in order to provide sufficient clearance for drills or augers, which conventionally are a standard five feet (~1½ m) in length.

More importantly, the hydraulic vertical drive system has no cables which can stretch (nor chains which need lubrication). Better yet, the hydraulic vertical drive system is substantially recoilless. When feeding down or retracting up against a stuck object, as soon as the sticking force is overcome the hydraulic vertical drive system does not recoil. In contrast, cables stretch or the stuck object (if being retracted up) can let fly after being unstuck (or after being torn apart), chains can whip and so on. Moreover, cables can snap, so can chains. Accordingly, the hydraulic vertical drive system gives precise control over the force applied to downhole tools or objects.

Arguably most significant of all is that, its brute power aside and in spite of being the most powerful system on the carrier/drill rig, the hydraulic vertical drive system is probably the safest.

Now let's return the discussion back to the present problem. The prior art conventionally extracts (PVC pipe) well casing with a grapple that engages the casing at the very bottom of the well. The grapple is fed down by winch and cable, and likewise hoisted up by the same winch and cable. For example, the prior art U.S. Pat. No. 6,615,919—Osgood et al., shows a knurled brass cylinder. The foregoing patent reference is incorporated herein by this reference thereto. It is also approximately illustrated in FIG. 2 hereof. Although the device of Osgood et al. has a solid shaft on the top, the shaft is short and so a cable is hooked to an eye on top of the shaft. The winch thus lowers the knurled brass cylinder the dozens (or hundreds) of feet by way of the cable all the way to the bottom of the well. Sand is poured in from the well head atop the cylinder to force wedging between the casing and cylinder.

To pull the casing, workers have to repetitively task through this exercise. That is, the winch is operated to reel the cable in as it courses over a sheave at the crown of the mast, about twenty-five feet (~11 m) above ground level. All the while, the workers have to be slitting the casing along an axial run along the sidewall. This is proposed to be done by a portable reciprocating power saw. At a time when twenty feet or so of the casing is withdrawn, then the workers have to stop because the casing is about to hit the sheave at the crown of the mast. The workers then cut-off the withdrawn twenty-foot section casing. Since the cut-off portion of the casing is also slit, then it has to be peeled off the cable in order to displace it free of the cable.

Then the workers can withdraw a fresh new twenty foot section of the casing, slitting it's sidewall all the while, stop, cut-off at ground level, peel-off too, and so on repetitively until the entire casing is withdrawn this way.

The foregoing has shortcomings. The winches are often underpowered for the task. Moreover, to cause the casing to release from its concrete backfill there is oftentimes a considerable pulling force applied, and the cable is considerably stretched. When the casing does break free, things fly. The casing is likely to shoot up like a projectile, the cable is likely to relax and whip around. It is a dangerous moment. Also, if the cable breaks or the grapple is irretrievably caught, then there are no practical options for fishing out the grapple, and so the well is abandoned as is, and with the grapple and (PVC pipe) casing in place. Additionally, the task of splitting the PVC pipe along the axial length thereof in runs of twenty-foot sections is slow work. Care must be exercised not to damage the saw, not to mention the cable.

What is needed is a solution to overcome the shortcomings of the prior art.

SUMMARY OF THE INVENTION

These and other aspects and objects are provided according to the invention in a well pipe casing extractor in accordance with the invention. It bears some resemblance to an enlarged pipe-thread tap. A well pipe casing extractor in accordance with the invention preferably has a leading guide section, eg., a smooth-walled cylindrical section. The optional guide section preferably is included for assisting alignment of the beveled thread-cutting section which follows. The well pipe casing extractor is suspended under and driven by the traveling rotary table and hydraulic vertical drive system. Well pipe casing is pulled by the extractor in accordance with the invention by the tops of such well pipe casings, and unlike the prior art, which grapples well pipe casings at their very bottom.

With a well pipe casing originally trimmed-down to at or near about the well head (eg., about ground level or a little above, or even below if the well head is sunk into a shallow manhole), work begins as follows. That is, the extractor is chucked into the drill drive of the traveling rotary table, which is lowered to insert the extractor's guide section into the open top of the well casing pipe. When the beveled thread-cutting section get lowered down to the pipe, the extractor is twisted by the hydraulics of the traveling rotary table. Thus the extractor self-taps itself tightly into the top of the well pipe casing.

Then the hydraulic vertical drive system's hydraulic cylinders, with their 30,000 pounds (~13,600 kg) or so of muscle, withdraw the well casing up about five feet (1½ m), and stop. By this scenario, workers can now cut-off the withdrawn five foot (1½ m) section at the well head or ground level and the like (and with a battery-powered portable reciprocating saw). The self-tapped pipe extractor is freed of the hanging casing section by a simple expedience. A worker merely takes a miner's hammer (eg., a carpenter's hammer sized pick ax) and shatters the pipe (if PVC and not stainless) with the spike end of the miner's hammer. Again, the dangling casing section is hammered upon in the upper vicinity (eg., around the cutting crests of the extractor) until it shatters off.

That is, the PVC is relatively brittle, and is expediently shattered off with a spike. By these means, there never is any tool in the hole which can get stuck, and potentially not be fished out. Also, if the well pipe casing ruptures/severs at well-head level or above (or even somewhat downhole), nothing is lost. The well pipe casing withdrawal can continue on as described above.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
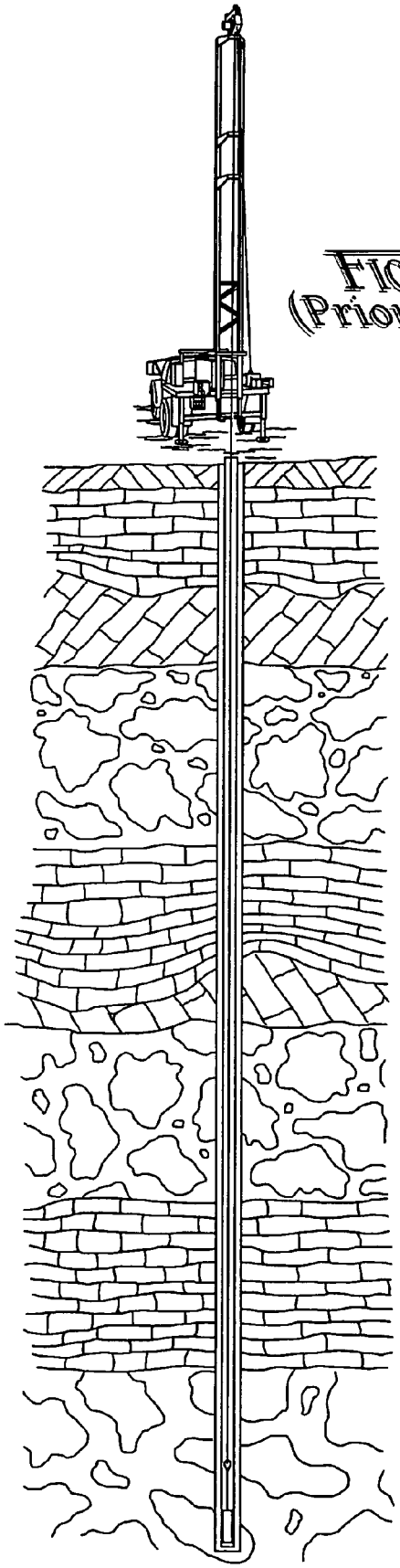
FIG. 1 (Prior Art)
FIG. 1 is a perspective view, partly in section, of a decommissioning project for an environmental groundwater-monitoring well and which project is being practiced in accordance with the prior art.

FIGS. 3 through 7 show a tool 111 and method in accordance with the invention for extracting (eg., withdrawing) down-hole hollow tubeforms from out of wells. Typically this nowadays is mandated by regulation to withdraw the well pipe casing 113 during abandonment (decommissioning) of environmental monitoring or remediation wells of groundwater.

A well of this kind is characterized by a well head 112 (see FIG. 5) at or near ground level. Sometimes the actual wellhead 112 is more accurately sunk in a shallow manhole (not shown), covered by a lockable manhole cover, to be not only less obtrusive to the landscape but also protect against unauthorized entry. The well pipe casing 113 is typically a segmented assembly of several sections of pipe which have counterpart internal and external threaded-ends (not shown) which screw together to form a uniform conduit. The lowest ten feet (~3 m) or so is typically a screen (eg., perforated section) to allow groundwater at the chosen sub-elevation to seep in. Typically the casing pipe 113 is PVC (polyvinyl chloride). Glue is typically forbidden because the glue is considered a potential source of contamination. The casing is fully surrounded by a backfill 115. For the lowest ten feet (~3 m) or so (eg., corresponding to the height of the screen), the material of the backfill 115 is typically sand. Above that, the remainder of the backfill 115 typically comprises a cement (ie., concrete) or bentonite annulus. Accordingly, the well pipe casing 113 is fairly securely locked in.

However, at the end of the use life of the well, regulatory authorities prefer (or mandate) that the well be decommissioned as by withdrawing the well pipe casing 113 and then filling in the casing-less downhole all the way up with cement. This decommissioning can occur anywhere after the well is only one month old or, in other instances, after a decade, especially in matters of decommissioning old wells which were not previously required to be decommissioned after their use life.

The pipe extractor tool 111 in accordance with the invention is designed for drillers inasmuch as it is designed to be lifted and driven by conventional carrier/drill rigs 117 which such drillers are likely to possess in their fleet of vehicles and equipment. The inventive pipe extractor tool 111 is designed to extract all of the well pipe casing 113 including the bottom screen section. The inventive pipe extractor tool 111 is scalable as necessary but conventionally well pipe casing 113 of this kind varies between ¾-ths to six inch-diameter PVC pipe (~two to fifteen cm-diam.).

Figure 4:
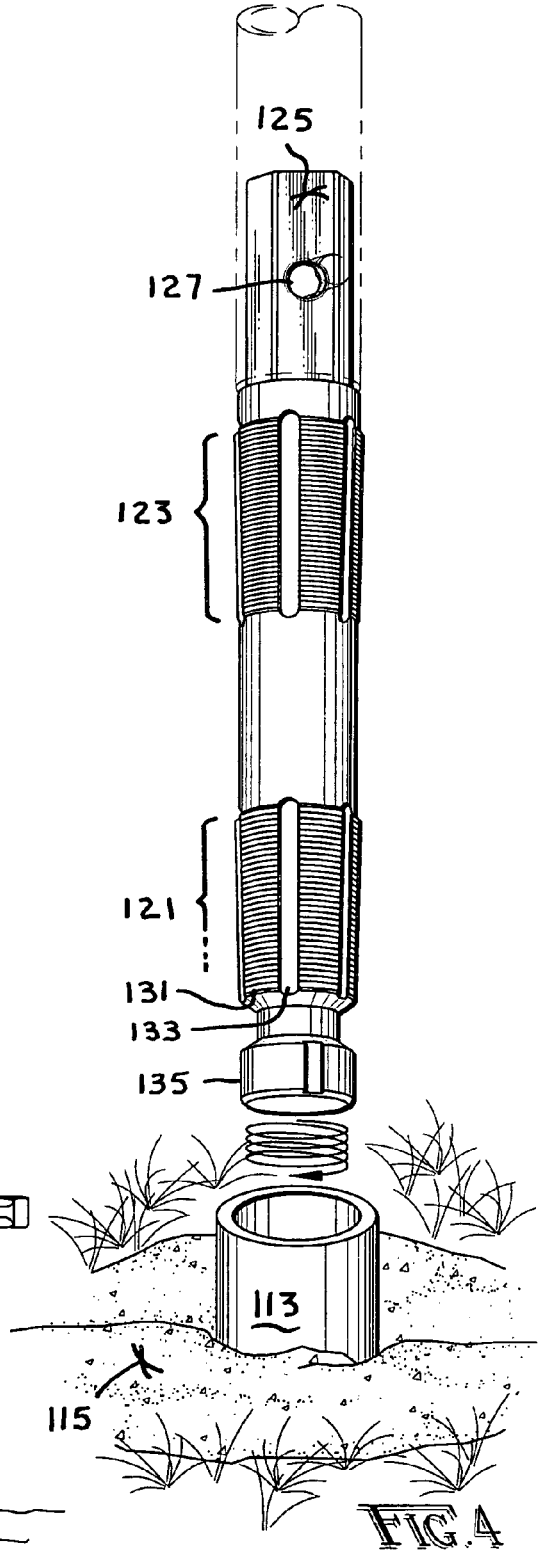
FIG. 4 is an enlarged scale perspective view of detail IV-IV in FIG. 3.

As FIG. 4 shows better, the inventive pipe extractor tool 111 has a solid steel construction comprising a shank on which is formed two spaced beveled (tapered) thread-cutting sections. The shank's butt end 125 terminates in a coupling formation for chucking to the drill drive 119 of a driller's rig. Typically but not exclusively the drill drive 119 terminates in a hexagonal socket. Hence the shank has a hexagonal butt end 125 for insertion in such. In addition, the butt end 125 includes a radial pin-socket or -hole 127 (eg., a radial throughhole in the drawings) for accepting a locking pin. Conventional hexagonal sockets of drill drives 119 vary among being 1⅛, to 1⅝ or 2 inches (2.86 cm, 4.13 cm, 5.08 cm respectively) for coupling to drill rods.

The beveled thread-cutting sections 121 and 123 are preferably constructed for cutting the internal thread common to pipe fittings. To revisit the matter of standard casing sizes, the two most commonly specified casing sizes are believed to be two inch and four inch (~five and ~ten cm) PVC pipe. To consider the four inch (~10 cm) PVC pipe, it might be specified to have a wall thickness of either Schedule 40 or Schedule 80. Hence the leading (lower) beveled thread-cutting section 121 is designed for Schedule 80 four-inch (~10 cm) PVC pipe. Correspondingly, the trailing (upper) beveled thread-cutting section 123 is designed for not Schedule 80 but Schedule 40 four-inch (~10 cm) PVC pipe. For example, the leading (lower) beveled thread-cutting section 121 might be designed to produce 2⅞ API regular pipe thread (eg., American Petroleum Institute). In other part, the trailing (upper) beveled thread-cutting section 123 might be designed to produce 3½ API regular pipe thread.

The beveled thread-cutting sections 121 and 123 comprise an angularly-spaced procession of lands 131 spaced by chip-ejecting flutes 133. Both the lands 131 and flutes 133 extend along axially-straight courses. The lands 131 comprise an axial procession of crests spaced by roots.

The inventive pipe extractor tool 111 optionally includes the leading end being formed as a preferred alignment guide 135. The alignment guide 135 substantially comprises cylindrical sidewall (with a leading chamfer) sized to fit snugly in at least the Schedule 80 pipe. The alignment guide 135 will of course be less snug in Schedule 40 pipe but then the leading (lower) beveled thread-cutting section 121 will be fulfilling much of the same role in the thinner-walled Schedule 40.

Figure 3:
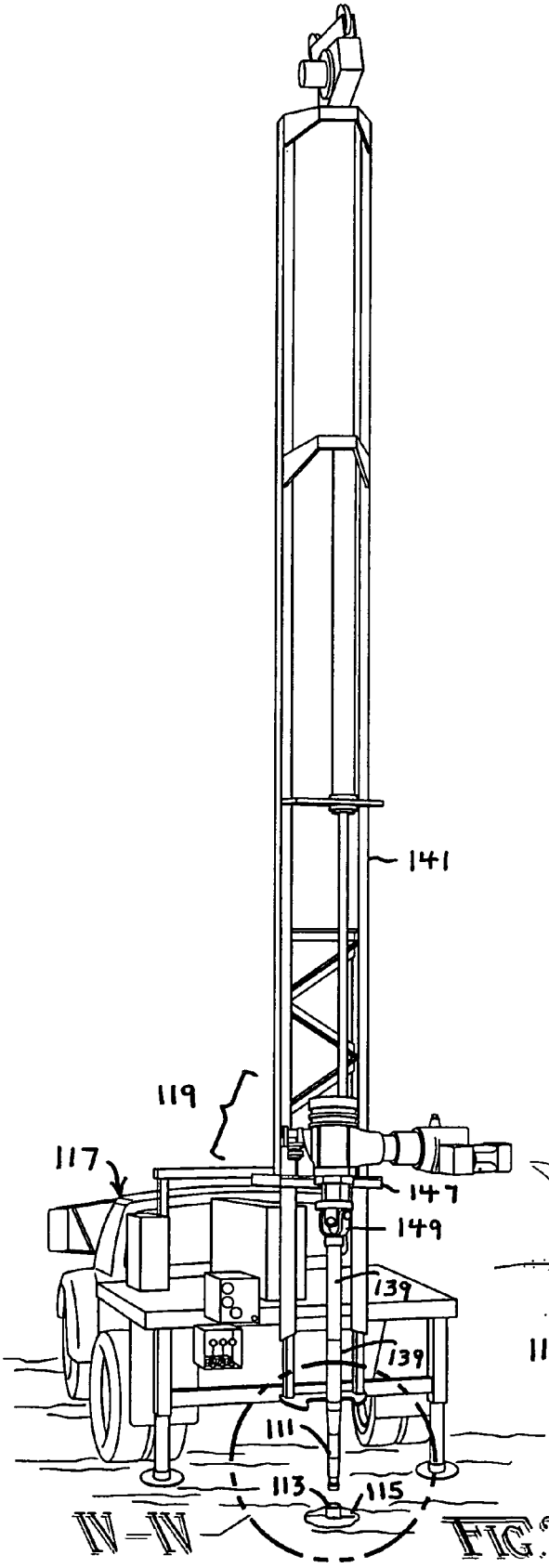
FIG. 3 is a perspective view comparable to the top-half of FIG. 2 except not only on enlarged scale but also showing such a decommissioning project of an environmental groundwater-monitoring well that is being practiced in accordance with the invention.
Figure 5:
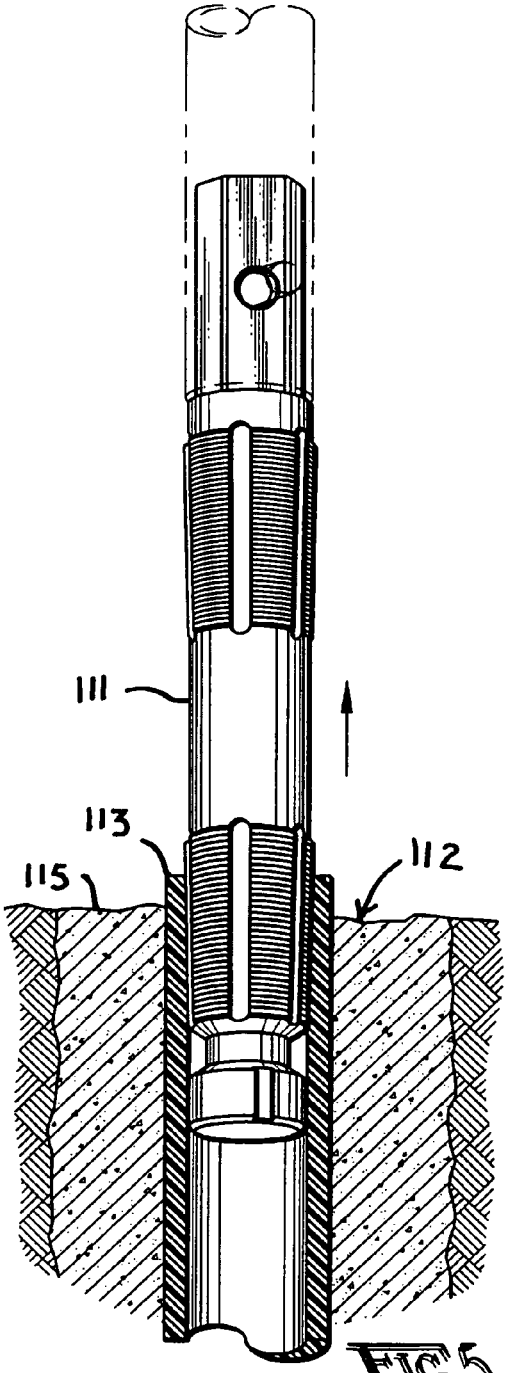
FIG. 5 is a perspective view, partly in section, comparable to FIG. 4 except showing the pipe extractor tool in accordance with the invention twisted part way into the open top of the well pipe casing.
Figure 6:
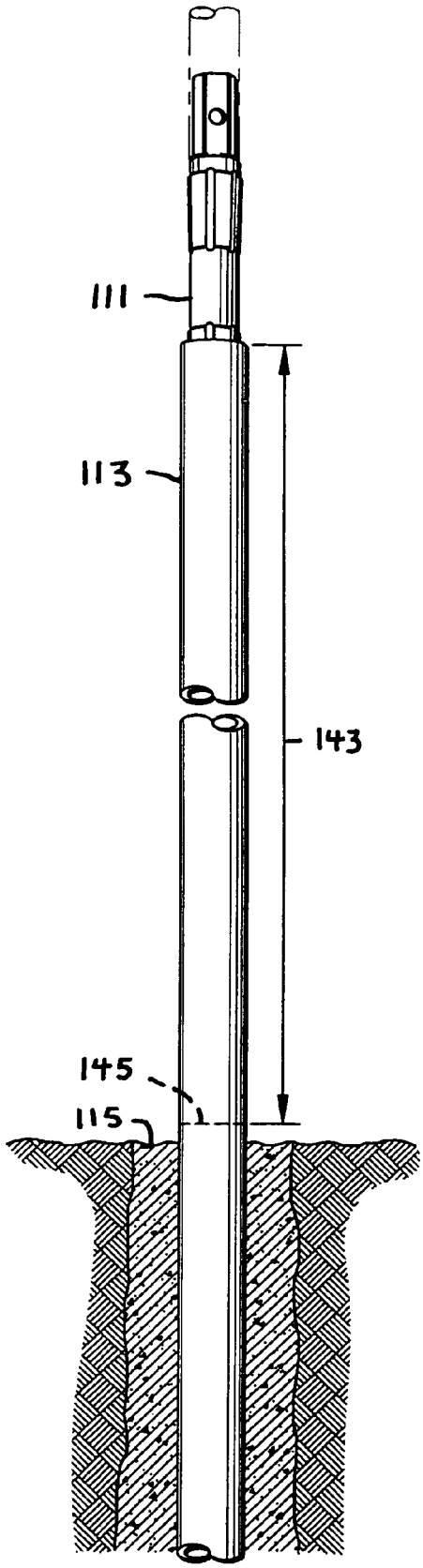
FIG. 6 is a reduced scale perspective view, partly in section, comparable to FIG. 5 except showing the pipe extractor tool in accordance with the invention having been retracted up (by a hydraulic vertical drive system that is not in view) in order to withdraw the well pipe casing out of the well by the incremental measure indicated.

In use, elongate casing pipe 113 is withdrawn from a well preferably by the following steps. The inventive pipe extractor tool 111 is lifted and brought into a preparatory position as shown by FIGS. 3 and 4 by a drilling rig 117 including without limitation a carrier/drill rig 117 having a tower 141 and a hydraulic vertical drive system. As FIG. 5 shows, the pipe extractor tool 111 is twisted into the casing pipe 113's open top until a sufficient threaded engagement is achieved between the two. FIG. 6 shows next that the inventive pipe extractor tool 111 is driven through a retraction stroke 143 such that the casing pipe 113 is drawn out of the well through the well head 112. The retraction stroke 143 is likely to be relatively diminutive in relation to the depth of the casing pipe 113. Therefore, to withdraw the whole casing pipe 113, this will have to be accomplished by a series of pulls. In consequence, if after the end of any given retraction stroke 143, and not all of the casing pipe 113 is drawn out of the well, then the preferred mode of use further comprises severing the casing pipe 113 at or near the well head 112. This produces a new open top for that much of the casing pipe 113 that remains in the well, as indicated by elevation 145 in FIG. 6.

The casing pipe 113 can severed or sawed through by the convenience of a relatively weak power tool, namely a battery-operated, portable reciprocating power saw (not shown). It can even be done by a hand hacksaw. It certainly does not require a chainsaw or the like.

Figure 7:
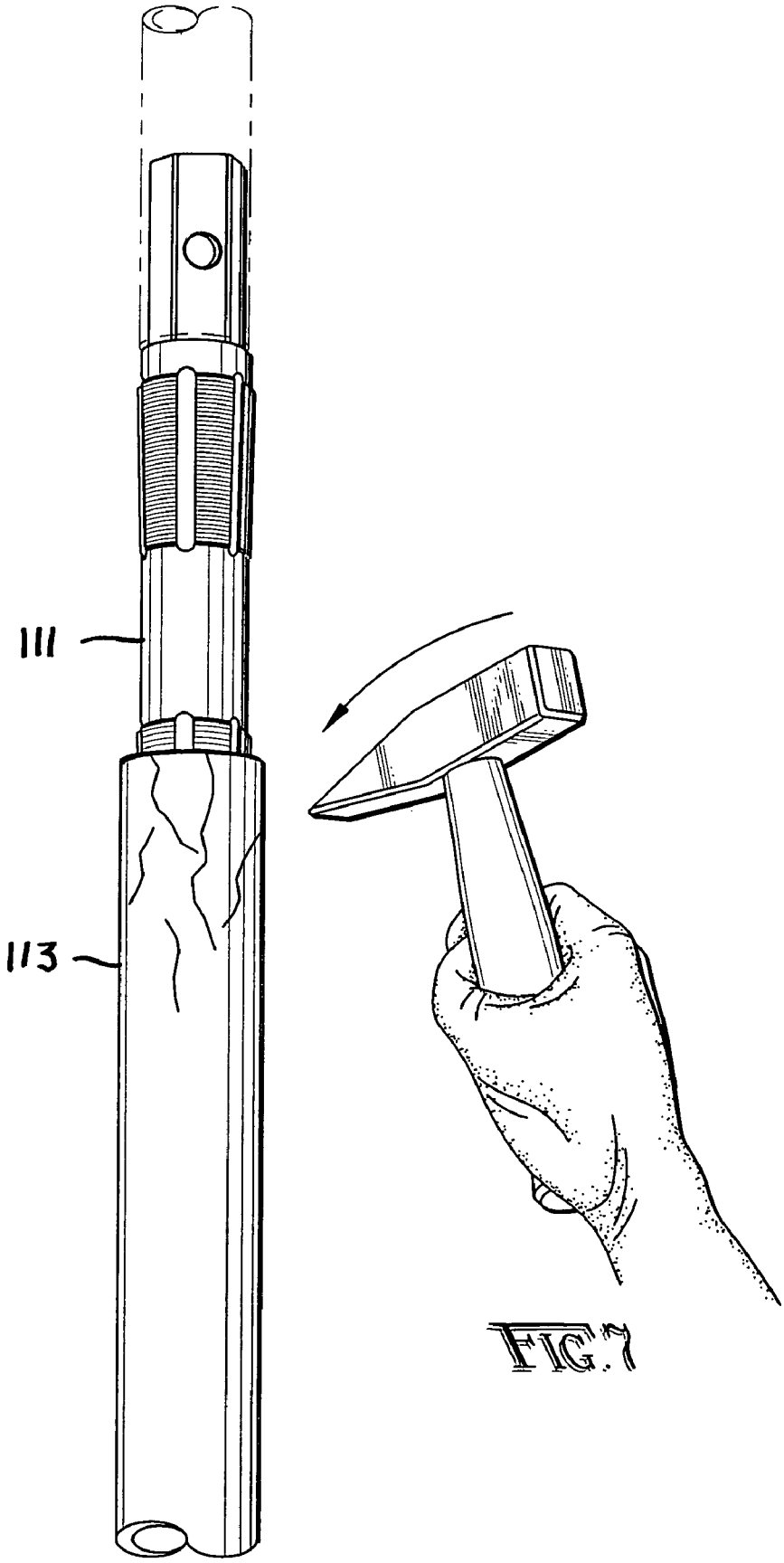
FIG. 7 is an enlarged scale perspective view comparable to the top-half of FIG. 6 except showing the activity of the well pipe casing being shattered off the inventive pipe extractor tool by hammer blows.

Next, a worker has to liberate the pipe extractor tool 111 from the dangling section of cut-off and withdrawn casing pipe 113. For PVC pipe, it has been advantageously discovered that simply whacking the casing pipe 113 with a miner's hammer as shown in FIG. 7 sufficiently breaks up or even shatters the PVC such that the fragments can be simply brushed off the beveled thread-cutting section(s) 121 and/or 123.

Once the dangling and cut-off section of withdrawn casing pipe 113 is cleaned/cleared off the inventive pipe extractor tool 111 (including its involved beveled thread-cutting section 121 or 123), the inventive pipe extractor tool 111 is ready anew for withdrawing a successive increment of casing pipe 113. Hence the sequence of activities illustrated by FIGS. 4 through 7 show the repetitious sequence that is repeated to pull out hundreds of feet of a well pipe casing 113 in about five foot increments (eg, by the measure of retraction stroke 143 in FIG. 6 or the like) or so.

It is an aspect of the invention that each beveled thread-cutting section 121 and 123 flares out from a leading (lower) minor diameter to a trailing (upper) major diameter. It is preferred if the major diameter for the leading (lower) beveled thread-cutting section 121 corresponds to median-wall diameter for one schedule of pipe (eg., Schedule 80) while the major diameter for the trailing (upper) beveled thread-cutting section 123 corresponds to median-wall diameter for a thinner-walled schedule of pipe (eg., Schedule 40). That way, each intended beveled thread-cutting section 121 or 123 is sized to be able to cut thread which extends at the outermost only half-way through the intended schedule of pipe.

It is preferred if the inventive pipe extractor tool 111 is cycled through feed (pulldown) and retraction strokes by a linkage to a hydraulic cylinder such that unsticking the casing pipe 113 free of a sticking force is substantially recoilless. FIG. 3 shows one example, where the drill drive 119 is suspended below a traveling rotary table 147 of the drill tower 141. The drill drive 119 includes a pair of serially suspended solid links interconnected by a U-joint 149. The lower of the two links typically terminates at the bottom thereof in a hexagonal socket (not in view). The inventive pipe extractor tool 111 is suspended below that U-joint 149 by one or two extension sections 139, as shown.

The drill tower 141 comprises a hydraulic vertical drive system for the traveling rotary table 147 which includes one or more hydraulic cylinders. Again, more particular details for an illustrative hydraulic vertical drive system can be had by reference to above-mentioned U.S. Pat. Nos. 3,527,309; 3,561,545 and/or 4,638,871—all of which are by C. L. Rassieur. Again, the foregoing patent disclosures are incorporated fully herein by this reference thereto. In consequence, cycling the inventive pipe extractor tool 111 between feed (eg., pulldown) or retraction strokes by the traveling rotary table 147 against a sticking force does so with increasing force until the hydraulics over-power and break free of the sticking force, without recoil. The hydraulics just stop.

FIG. 4 shows the activity of twisting the inventive pipe extractor tool 111 into the casing pipe 113's open top until a sufficient threaded engagement is achieved. This is simply done until a desired number of turns have been made or until the casing pipe 113 begins to spin. The sufficiency of the threaded engagement can be tested by forcing the inventive pipe extractor tool 111 through initiating a retraction pull. If the inventive pipe extractor tool 111 strips free, then workers return to twisting the inventive pipe, extractor tool 111 into the casing pipe 113's open top for a another plurality of full turns or until again the casing pipe 113 begins to spin, and further repeating the initiation of a retraction pull on the tool 111. In the experience of the inventor hereof, stripping is rare, and he cannot recall an instance of two successive instances of stripping.

In practice, generally fewer threads than shown by FIG. 5 are sufficient. Also, it is generally the experience that the casing pipe 113 begins to spin after a few coils of thread are cut, which is the ordinary indication that sufficient twisting has been accomplished.

The invention provides several distinguished advantages, including the elimination of safety issues involving use of winched-up chains and/or cable. The moment of popping the PVC casing pipe 113 free of the concrete backfill 115 may take 8,000 to 40,000 pounds (3,600 to 18,000 kg) of pull. And when it does pop loose, the casing is momentarily freed and in some instances behaves as if launched like artillery fire. Slack cable or chain is dangerous at these times, being free to whip about. In contrast, the hydraulic vertical drive system just stops in place. Therefore, the invention affords opportunity to practice a safer method of withdrawing the well pipe casing 113.

Figure 2:
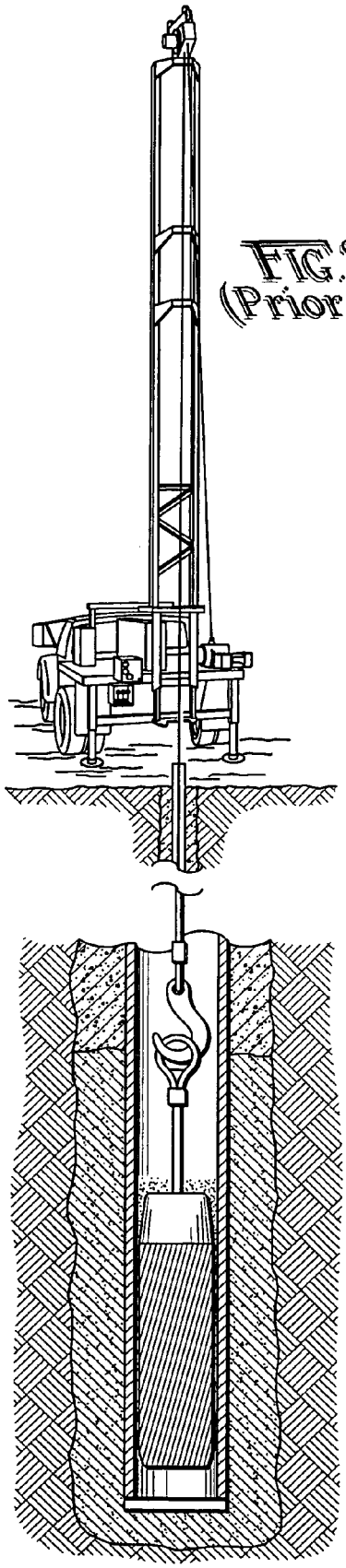
FIG. 2 (Prior Art)
FIG. 2 is a split perspective view, comparable to FIG. 1 except on an enlarged scale and with central portions broken away.

Additionally, if workers happen to sink one of the prior art wedging grapples in the well (eg., FIGS. 1 and 2) and get it stuck, then the workers thereafter have a problem on their hands, including the risk of losing a costly grapple permanently stuck downhole.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method of withdrawing elongate polymeric casing pipe from a well in sections and through a well head thereof, comprising the activities of:

supplying a thread tap adapted to cut internal thread in the casing pipe's wall;

twisting the thread tap into the casing pipe's open top until a sufficient threaded engagement is achieved;

forcing the thread tap through a retraction stroke such that the casing pipe is drawn out of the well through the well head;

at the end of the retraction stroke, if not all of the casing pipe is drawn out of the well then severing the casing pipe into a severed-off section at or near the well head, which produces a new open top for that much of the casing pipe that remains in the well;

liberating the thread tap and repeating at will the activities beginning with twisting the thread tap into the casing pipe from the open top thereof;

wherein liberating the thread tap comprises breaking up the polymeric casing pipe with a striking object.

2. A method of withdrawing elongate casing pipe from a well in sections and through a well head thereof, comprising the activities of:

supplying a thread tap adapted to cut internal thread in the casing pipe's wall;

twisting the thread tap into the casing pipe's open top until a sufficient threaded engagement is achieved;

forcing the thread tap through a retraction stroke such that the casing pipe is drawn out of the well through the well head;

at the end of the retraction stroke, if not all of the casing pipe is drawn out of the well then severing the casing pipe into a severed-off section at or near the well head, which produces a new open top for that much of the casing pipe that remains in the well;

liberating the thread tap and repeating at will the activities beginning with twisting the thread tap into the casing pipe from the open top thereof;

providing the thread tap with a beveled thread-cutting section; and further providing the thread tap with a shank section trailing the beveled thread-cutting section, which shank section includes coupling formations adapted for coupling with a drive source that cycles the thread tap between feed and retraction strokes as well as twists the thread tap for making the threaded engagement;

wherein the coupling formations are never fed below the elevation of the well head.

3. The method of claim 2 wherein the beveled thread-cutting section flares out from a leading minor diameter to a trailing major diameter, which major diameter generally corresponds to about half the casing pipe's wall-thickness.

4. The method of claim 2 further comprising providing the thread tap with a leading guide section preceding the beveled thread-cutting section.

5. The method of claim 4 wherein leading guide section includes a cylindrical sidewall.

6. The method of claim 2 wherein the coupling formations comprise a hexagonal exterior adapted for coupling to a hexagonal socket and a transverse socket adapted for receiving a locking pin.

7. A method of withdrawing elongate casing pipe from a well in sections and through a well head thereof, comprising the activities of:

supplying a thread tap adapted to cut internal thread in the casing pipe's wall;

twisting the thread tap into the casing pipe's open top until a sufficient threaded engagement is achieved;

forcing the thread tap through a retraction stroke such that the casing pipe is drawn out of the well through the well head;

at the end of the retraction stroke, if not all of the casing pipe is drawn out of the well then severing the casing pipe into a severed-off section at or near the well head, which produces a new open top for that much of the casing pipe that remains in the well;

liberating the thread tap and repeating at will the activities beginning with twisting the thread tap into the casing pipe from the open top thereof;

wherein forcing the thread tap through a retraction stroke further comprises coupling the thread tap by a linkage to a hydraulic cylinder such that unsticking the casing pipe free of a sticking force is substantially recoilless.

8. The method of claim 7 wherein repeating at will further comprises repeating said activities until the last of the casing pipe, including any terminal screen section if any, is drawn out of the well head.

9. The method of claim 7 wherein the linkage comprises a pair of serially suspended solid links interconnected by a U-joint, the lower of which links is either directly coupled to the thread tap or indirectly so by one or more fixed-together other solid links.

10. A method of withdrawing elongate casing pipe from a well in sections and through a well head thereof, comprising the activities of:

supplying a thread tap adapted to cut internal thread in the casing pipe's wall;

twisting the thread tap into the casing pipe's open top until a sufficient threaded engagement is achieved;

forcing the thread tap through a retraction stroke such that the casing pipe is drawn out of the well through the well head;

at the end of the retraction stroke, if not all of the casing pipe is drawn out of the well then severing the casing pipe into a severed-off section at or near the well head, which produces a new open top for that much of the casing pipe that remains in the well;

liberating the thread tap and repeating at will the activities beginning with twisting the thread tap into the casing pipe from the open top thereof; and supplying a drilling tower which includes a traveling rotary table adapted for suspending, rotating as well as feeding down and retracting well tools therebeneath;

wherein the activity of forcing the thread tap through a retraction stroke further comprises inter-coupling the thread tap to the traveling rotary table.

11. The method of claim 10 wherein the drilling tower further comprises a vertical drive system for the traveling rotary table which includes one or more hydraulic cylinders such that feeding down or retracting the traveling table against a sticking force with increasing force until over-powered and broken free thereof transpires substantially without recoil.

12. A method of withdrawing elongate casing pipe from a well in sections and through a well head thereof, comprising the activities of:

supplying a thread tap adapted to cut internal thread in the casing pipe's wall;

twisting the thread tap into the casing pipe's open top until a sufficient threaded engagement is achieved, which comprises twisting the thread tap into the casing pipe's open top for a plurality of full turns or until the casing pipe begins to spin;

forcing the thread tap through a retraction stroke such that the casing pipe is drawn out of the well through the well head;

at the end of the retraction stroke, if not all of the casing pipe is drawn out of the well then severing the casing pipe into a severed-off section at or near the well head, which produces a new open top for that much of the casing pipe that remains in the well;

liberating the thread tap and repeating at will the activities beginning with twisting the thread tap into the casing pipe from the open top thereof;

testing the sufficiency of the threaded engagement by forcing the thread tap through a retraction stroke and if the thread tap strips free, then returning to twisting the thread tap into the casing pipe's open top for a another plurality of full turns or until again the casing pipe begins to spin, and further repeating the testing of the sufficiency of the threaded engagement.

* * * * *